US007216569B2

(12) United States Patent
Abdelgany

(10) Patent No.: US 7,216,569 B2
(45) Date of Patent: May 15, 2007

(54) SCREWDRIVER HANDLE

(75) Inventor: Mahmoud F. Abdelgany, Rockaway, NJ (US)

(73) Assignee: Custom Spine, Inc., Parsippany, NJ (US)

( * ) Notice: Subject to any disclaimer, the term of this patent is extended or adjusted under 35 U.S.C. 154(b) by 161 days.

(21) Appl. No.: 11/076,670

(22) Filed: Mar. 10, 2005

(65) Prior Publication Data

US 2006/0201287 A1 Sep. 14, 2006

(51) Int. Cl.
*B25B 23/16* (2006.01)
*B25G 1/00* (2006.01)

(52) U.S. Cl. ..... 81/177.5; 81/177.6; 81/177.7

(58) Field of Classification Search ..... 81/177.5, 81/177.8, 177.6, 177.7
See application file for complete search history.

(56) References Cited

U.S. PATENT DOCUMENTS

| | | | | | |
|---|---|---|---|---|---|
| 456,300 | A | * | 7/1891 | Dawson | 81/33 |
| 579,277 | A | | 3/1897 | Lord et al. | |
| 1,256,565 | A | | 2/1918 | Inghram | |
| 2,726,695 | A | * | 12/1955 | Malm | 81/440 |
| 3,186,009 | A | * | 6/1965 | Simmons | 7/168 |
| 4,000,767 | A | | 1/1977 | Geng | |
| 4,542,667 | A | * | 9/1985 | Jang | 81/177.2 |
| 4,611,514 | A | | 9/1986 | Hyde | |
| 4,825,734 | A | * | 5/1989 | Schwalbe et al. | 81/177.9 |
| 5,003,850 | A | | 4/1991 | Harkins | |
| 5,056,952 | A | | 10/1991 | Gringer | |
| 5,515,754 | A | * | 5/1996 | Elkins | 81/177.9 |
| 5,520,073 | A | | 5/1996 | Bakula | |
| 5,586,475 | A | | 12/1996 | Wenner | |
| 5,590,575 | A | | 1/1997 | Ludy | |
| 5,694,818 | A | | 12/1997 | Nickipuck | |
| 5,737,982 | A | | 4/1998 | Lin | |
| 5,927,162 | A | | 7/1999 | Huang | |
| 6,053,076 | A | | 4/2000 | Barnes | |
| 6,397,709 | B1 | * | 6/2002 | Wall | 81/440 |

* cited by examiner

*Primary Examiner*—Lee D Wilson
*Assistant Examiner*—Alvin J. Grant
(74) *Attorney, Agent, or Firm*—Gibb & Rahman, LLC; Mohammad S. Rahman, Esq.

(57) ABSTRACT

A screwdriver handle comprises a base portion; a pair of arms pivotally connected to the base portion; a locking sleeve mounted around the base portion and adapted to engage the pair of arms; a spring member mounted around the base portion and adapted to engage the locking sleeve; a torsion spring connected to the base portion and each of the pair of arms; and a pin connecting the pair of arms to the base portion. The base portion comprises at least one gripping indent feature and a hollow inner shaft chamber having a locking indent feature. The pair of arms are adapted to articulate from a first position planar to a longitudinal axis of the base portion to a second position transverse to the longitudinal axis of the base portion. The locking sleeve is adapted to move along a longitudinal axis of the base portion.

20 Claims, 8 Drawing Sheets

SCREWDRIVER HANDLE

BACKGROUND OF THE INVENTION

1. Field of the Invention

The embodiments of the invention generally relate to tools and, more particularly, to tool handles.

2. Description of the Related Art

Screwdrivers are configured with a wide assortment of handles to help the user secure a proper grip. Most screwdriver handles have various forms of indent features or gripping areas to allow a user to secure a better grip. However, users may not be able to properly get a good ergonomic grip when using screwdrivers, especially when high torque applications are involved such as trying to dislodge a rusted screw. Therefore, it is desirable to develop a novel screwdriver handle capable of allowing a user to use the screwdriver in higher torque applications.

SUMMARY OF THE INVENTION

In view of the foregoing, an embodiment of the invention provides a screwdriver handle comprising a base portion; at least one arm pivotally connected to the base portion; and a locking sleeve mounted on the base portion and adapted to engage the at least one arm. The screwdriver handle may further comprise a spring member mounted on the base portion and adapted to engage the locking sleeve. Moreover, the screwdriver handle may further comprise a torsion spring connected to each of the base portion and the at least one arm. The base portion may comprise a hollow inner shaft chamber. Additionally, the base portion may comprise at least one gripping indent feature. The at least one arm is preferably adapted to articulate from a first position planar to a longitudinal axis of the base portion to a second position transverse to the longitudinal axis of the base portion. Preferably, the at least one arm comprises two arms, wherein the two arms are diametrically opposed to one another when in the second position. The screwdriver handle may further comprise a pin connecting the at least one arm to the base portion. Furthermore, the locking sleeve is preferably adapted to move along a longitudinal axis of the base portion. Moreover, the at least one arm preferably comprises a pair of arms that are unconnected to one another.

Another aspect of the invention provides a screwdriver handle comprising a base portion; a pair of arms pivotally connected to the base portion; locking means for locking the pair of arms in a first position planar to a longitudinal axis of the base portion; first energy means for providing energy to the locking means to articulate from a locked to an unlocked position; and second energy means for providing energy to the pair of arms to articulate from the first position planar to the longitudinal axis of the base portion to a second position transverse to the longitudinal axis of the base portion.

The screwdriver handle provided by the embodiments of the invention may be used in any application where a screwdriver is used, and is particularly useful in heavy torque applications, where a user can open the arms and apply greater torque on a screw by rotating the arms of the screwdriver handle. Furthermore, in instances where the user does not need to apply significant amounts of torque to a screw or in applications where there are spatial limitations, the arms can be kept in the locked position (i.e., with the locking sleeve engaging the indented lip of the arms), and the screwdriver handle may be used in a traditional manner. In this regard, because the gripping indent features of the arms contours with the shape and configuration of the gripping indent features of the outer body surface of the base portion, a user can get a very good ergonomic grip on the screwdriver handle. Moreover, the matching shape and configuration of the gripping indent features contributes to the overall aesthetics of the screwdriver handle.

These and other aspects of the embodiments of the invention will be better appreciated and understood when considered in conjunction with the following description and the accompanying drawings. It should be understood, however, that the following descriptions, while indicating preferred embodiments of the invention and numerous specific details thereof, are given by way of illustration and not of limitation. Many changes and modifications may be made within the scope of the embodiments of the invention without departing from the spirit thereof, and the embodiments of the invention include all such modifications.

BRIEF DESCRIPTION OF THE DRAWINGS

The embodiments of the invention will be better understood from the following detailed description with reference to the drawings, in which.

DETAILED DESCRIPTION OF PREFERRED EMBODIMENTS OF THE INVENTION

Figure 1:
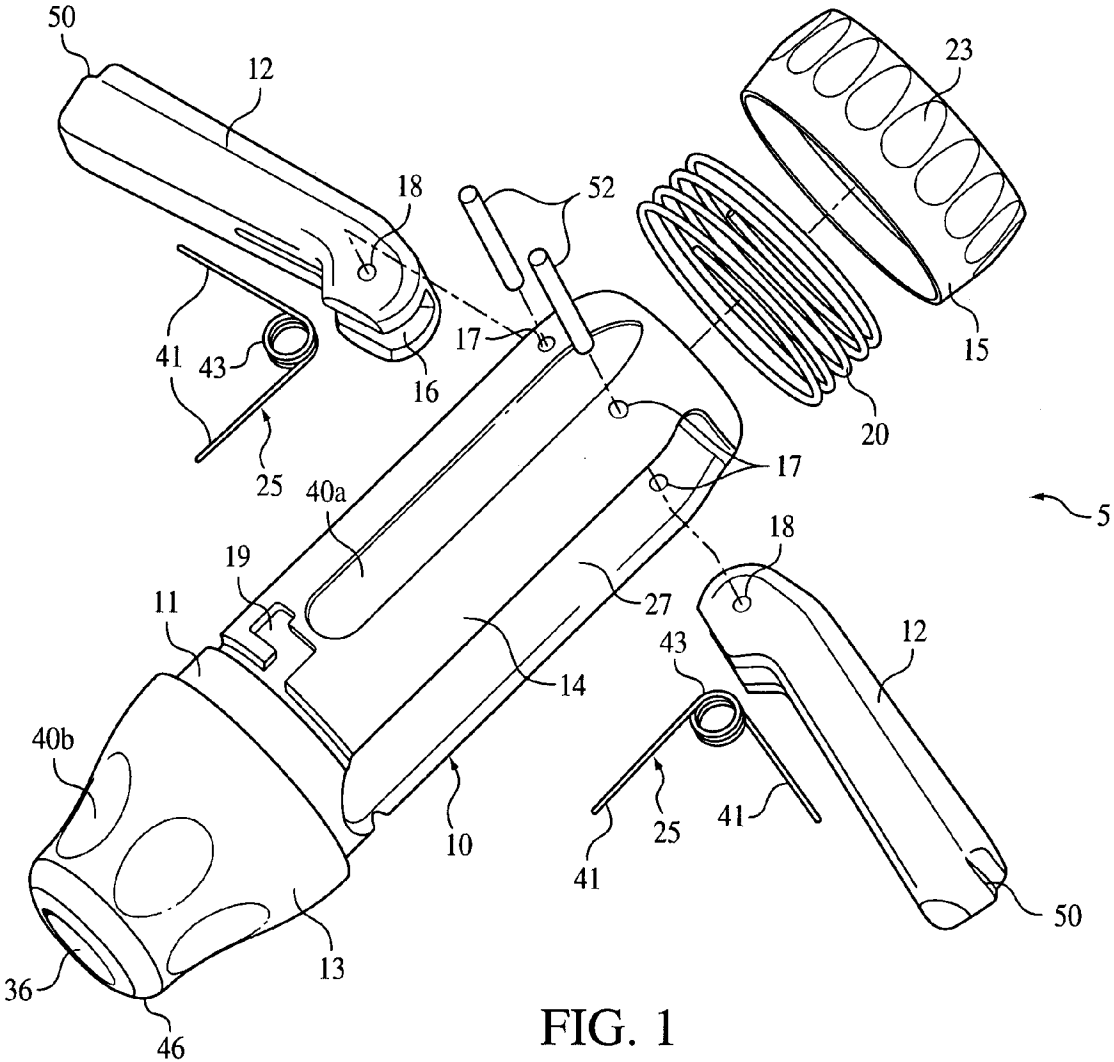
FIG. 1 illustrates an exploded view of a screwdriver handle according to an embodiment of the invention.

The embodiments of the invention and the various features and advantageous details thereof are explained more fully with reference to the non-limiting embodiments that are illustrated in the accompanying drawings and detailed in the following description. It should be noted that the features illustrated in the drawings are not necessarily drawn to scale. Descriptions of well-known components and processing techniques are omitted so as to not unnecessarily obscure the embodiments of the invention. The examples used herein are intended merely to facilitate an understanding of ways in which the embodiments of the invention may be practiced and to further enable those of skill in the art to practice the embodiments of the invention. Accordingly, the examples should not be construed as limiting the scope of the embodiments of the invention.

As mentioned, there remains a need for a novel screwdriver handle capable of allowing a user to use the screwdriver in higher torque applications. The embodiments of the invention achieve this by providing a screwdriver handle having retractable arms to allow the user to apply greater torque while rotating the screwdriver. Referring now to the drawings and more particularly to FIGS. 1 through 9 where similar reference characters denote corresponding features consistently throughout the figures, there are shown preferred embodiments of the invention.

Figure 2:
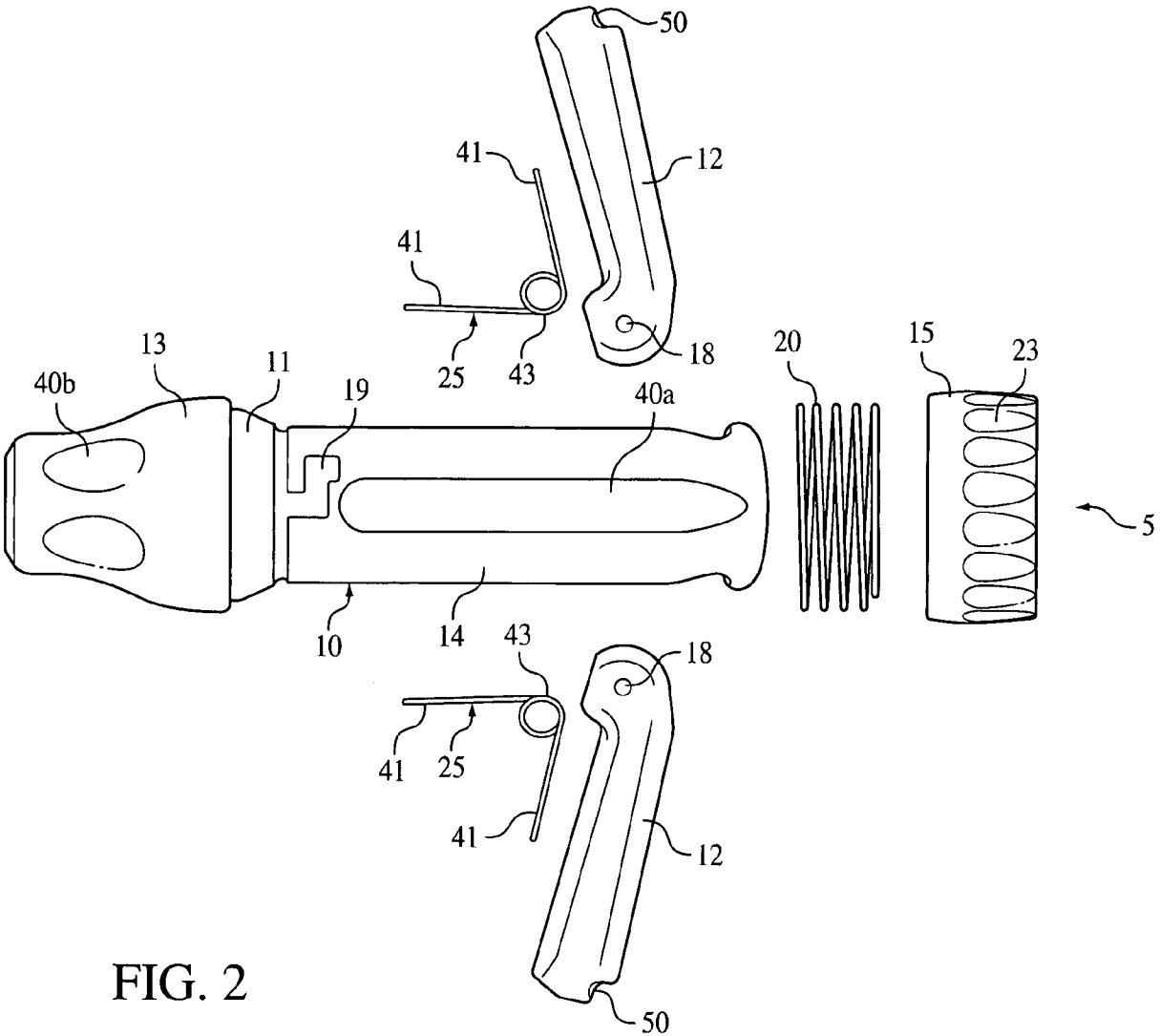
FIG. 2 illustrates an alternate exploded view of a screwdriver handle according to an embodiment of the invention.

FIGS. 1 and 2 illustrate exploded views of a screwdriver handle 5 according to an embodiment of the invention. Preferably, the screwdriver handle 5 comprises a generally elongated base portion 10 having an outer body surface 14 with at least one gripping indent feature 40*a* configured therein. However, those skilled in the art would readily appreciate that the screwdriver handle 5 may take any appropriate shape including non-elongated configurations such as spherical configurations. As such, the embodiments of the invention are not limited to one particular geometric configuration. The gripping indent feature 40*a* allows a user to securely grip the outer body surface 14 when using the screwdriver handle 5. The outer body surface 14 also includes a plurality of pin holes 17 configured through an upper portion of the base portion 10.

The base portion 10 further includes a pair of slotted regions 27 generally configured along the sides of the base portion 10 and generally extending the length of the base portion 10. The base portion 10 also includes a catch 19 generally configured towards the bottom of the outer body surface 14. The lower end 13 of the base portion 10 includes at least one gripping indent feature 40*b* configured therein. The gripping indent feature 40*b* allows a user to securely grip the lower end 13 of the base portion 10 when using the screwdriver handle 5. The lower end 13 includes a bottom surface 46 having a hole 36 configured therein. Furthermore, the base portion 10 includes a generally tapered joining segment 11 configured just above the lower end 13 and connecting to the catch 19.

The screwdriver handle 5 further includes a pair of arms 12 pivotally connected to the base portion 10, wherein the pair of arms 12 are preferably spaced apart from one another and are preferably not connected to one another. The arms 12 also include pin holes 18 similarly configured to the pin holes 17 of the base portion 10. Pins 52 are used to connect the arms 12 to the base portion 12, wherein the pin holes 17 of the base portion 10 are aligned with the pin holes 18 of the arms 12 and the pins 52 are inserted and secured into the aligned pin holes 17, 18, thereby securing the arms 12 to the base portion 10, while also allowing the arms 12 to pivotally articulate in relation to the base portion 10. Each arm 12 further includes an indented lip 50 preferably configured on the tip of the arm 12 located on the opposite end from where the pin holes 18 are configured.

The screwdriver handle 5 further includes a spring member 20 and a locking sleeve 15. The locking sleeve 15, which also includes gripping indent features 23, is generally positioned around the spring member 20. The gripping indent features 23 allow a user to securely grip the locking sleeve 15 when using the screwdriver handle 5. Additionally, the screwdriver handle 5 further comprises a torsion spring 25 connected to the base portion 10 and each of the pair of arms 12. The torsion spring 25 comprises a coiled central portion 43 and a pair of elongated ends 41 distally located from the coiled central portion 43.

Figure 3:
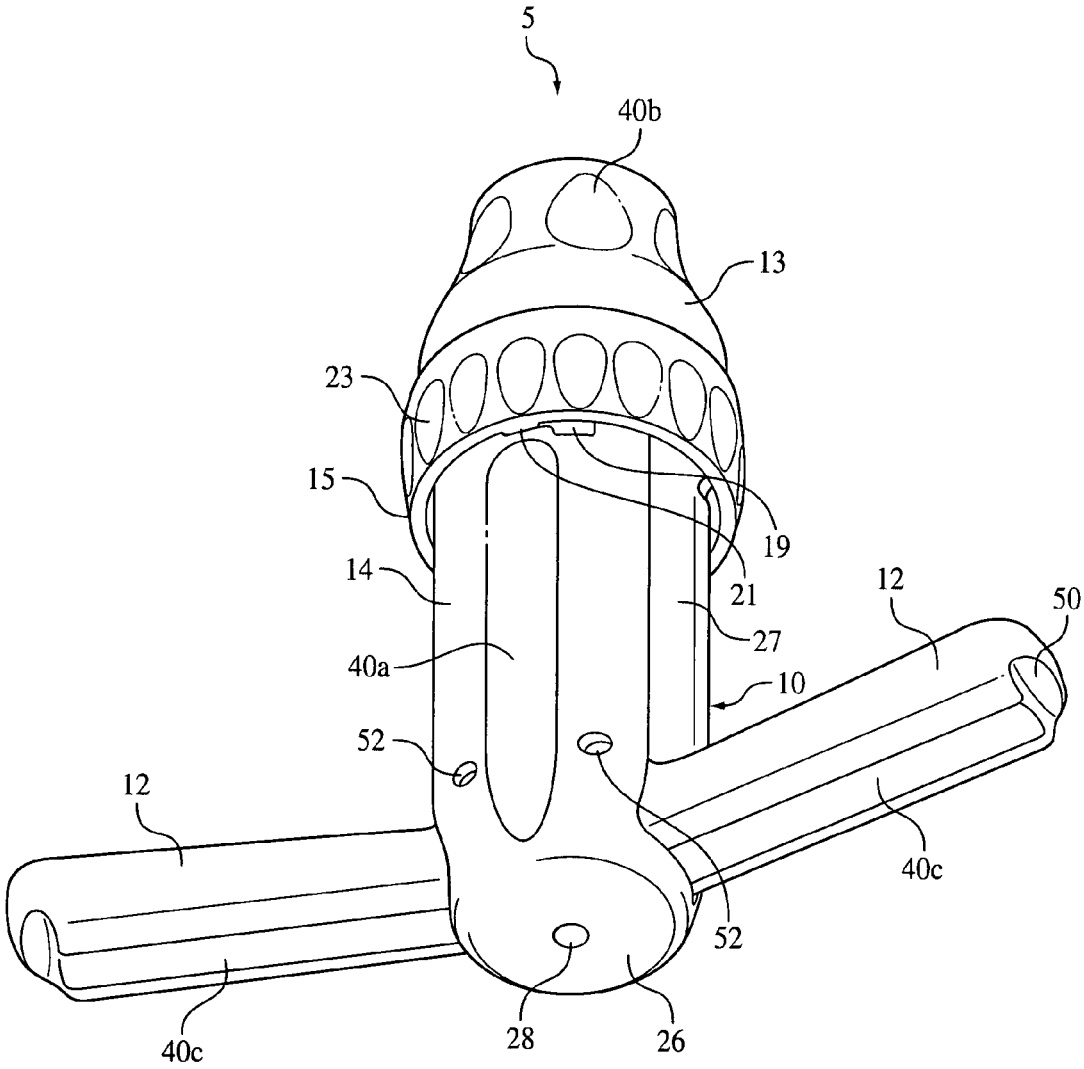
FIG. 3 illustrates a perspective view of a screwdriver handle in an open configuration according to an embodiment of the invention.

FIG. 3 illustrates the assembled screwdriver handle 5 with the pair of arms 12 in an open configuration; that is, in a position transverse to a longitudinal axis of the base portion 10. Here, the locking sleeve 15 is shown positioned next to the lower end 13 of the base portion 10 (around the tapered joining segment 11 (not shown in FIG. 3) of the base portion 10). The locking sleeve 15 includes a stop feature 21 which is dimensioned and configured to engage the catch 19 of the base portion 10. In this regard, the catch 19 prevents the locking sleeve 15 from moving past the edge of the catch 19. Furthermore, the generally tapered shape of the joining segment 11 prevents the locking sleeve and underlying spring member 20 (not shown in FIG. 3) from moving onto and past the lower end 13 of the base portion 10. As shown in FIG. 3, the base portion includes a top surface 26 having a small hole 28 configured therein. Moreover, FIG. 3 also illustrates that the arms 12 include a gripping indent feature 40*c* configured therein, wherein the gripping indent feature 40*c* is similarly configured to the gripping indent feature 40*a* of the outer body surface 14 of the base portion 10. The gripping indent feature 40*c* allows a user to securely grip the arms 12 (either in an open or closed configuration) when using the screwdriver handle 5.

Figure 4:
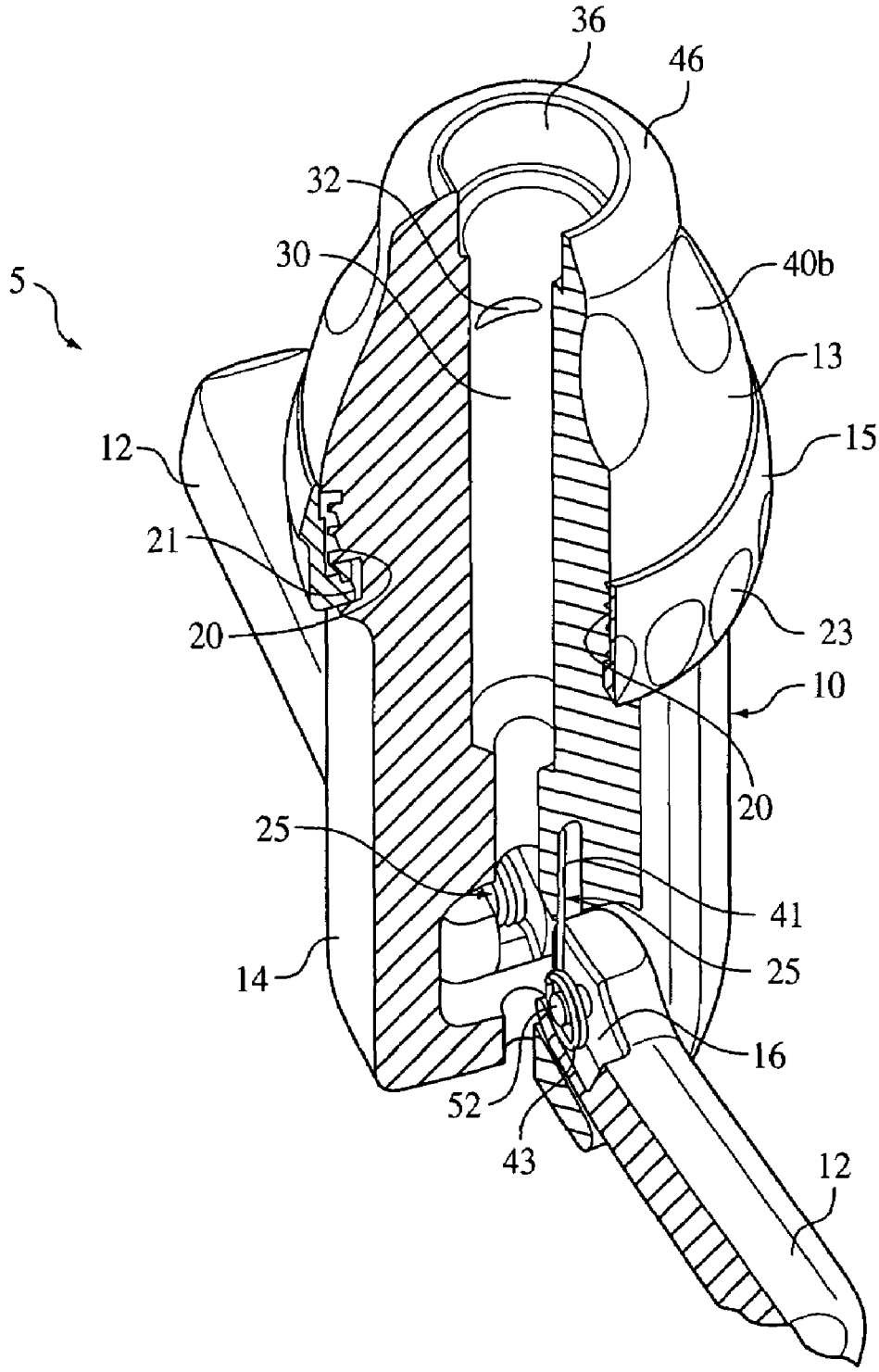
FIG. 4 illustrates a cross-sectional side view of a screwdriver handle in an open configuration according to an embodiment of the invention.

The cross-sectional view of FIG. 4 more particularly illustrates how the torsion spring 25 connects to the arm 12 and base portion 10 of the screwdriver handle 5. Generally, the torsion spring 25 fits into a slot 16 configured in the arm 12 and base portion 10. The coiled central portion 43 of the torsion spring 25 fits around the pin 52 with the elongated ends 41 being positioned in the slot 16 in each of the arms 12 and the base portion 10. The open configuration, which generally resembles a "T" shape, remains in this position due to the resistance provided by the torsion spring 25 against the arms 12.

Additionally, FIG. 4 illustrates a hollow inner shaft chamber 30 configured in the base portion 10 and extending from the hole 36 of the bottom surface 46 of the base portion 10. The hole 36 is configured to accommodate a shaft (not shown), which will engage a screw (not shown). Furthermore, the inner shaft chamber 30 includes a locking hole 32, which accommodates a cross pin (not shown), which inserts into a corresponding shaft hole (not shown) thereby locking the shaft (not shown) in the inner shaft chamber 30, which thereby locks the shaft (not shown) to the screwdriver handle 5. An example, of a cross pin and shaft that may be used and the manner in which they are inserted and locked into a shaft chamber is described in U.S. patent application Ser. No. 11/063,452, filed Feb. 23, 2005, and entitled "Screwdriver", the contents of which, in its entirety, is herein incorporated by reference.

Figure 5:
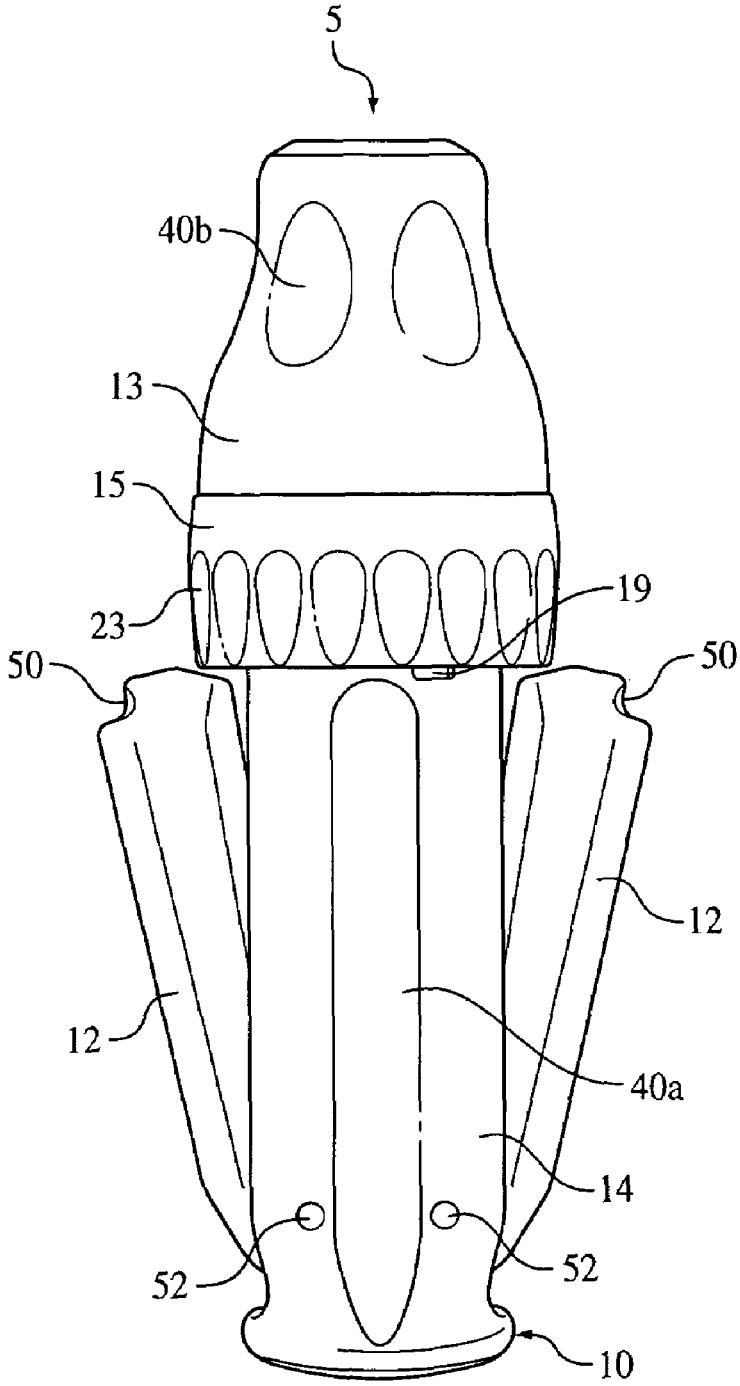
FIG. 5 illustrates a perspective view of a screwdriver handle in a partially closed configuration according to an embodiment of the invention.
Figure 6:
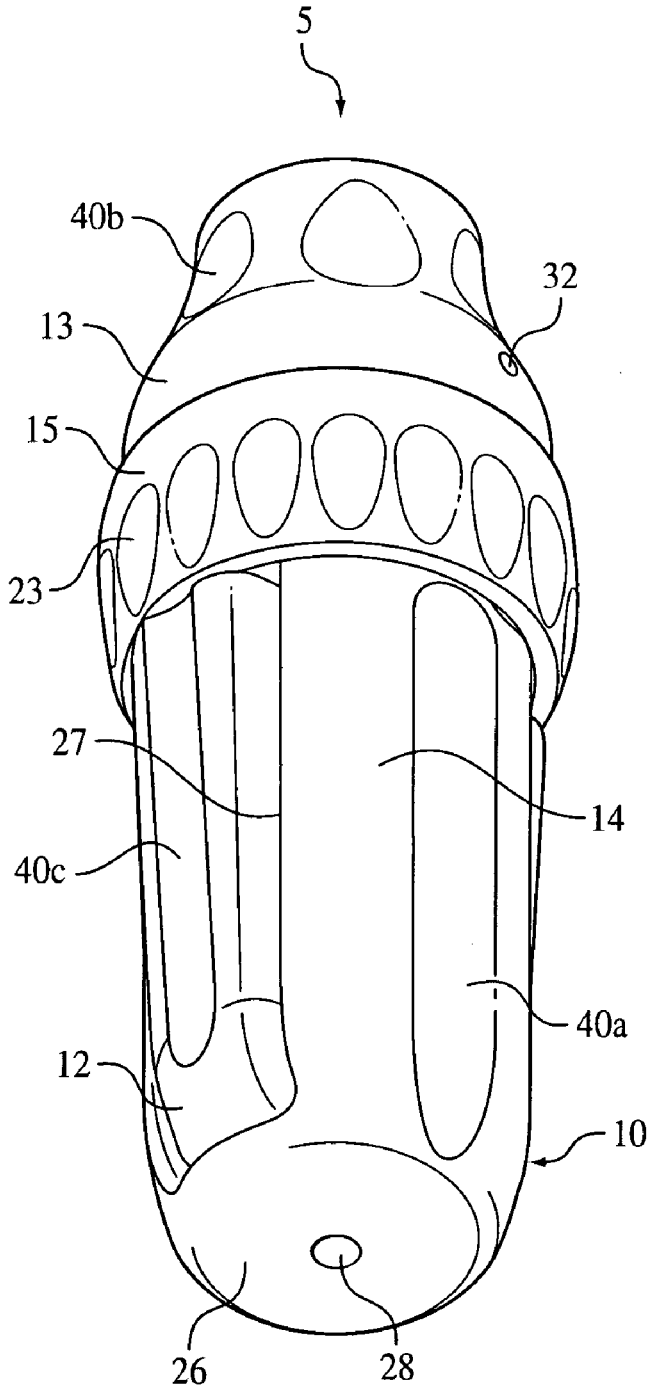
FIG. 6 illustrates a perspective view of a screwdriver handle in a closed configuration according to an embodiment of the invention.

FIG. 5 illustrates the screwdriver handle 5 in a partially closed configuration, whereby in order to move the screwdriver handle 5 from an open configuration to a closed configuration, a user (not shown) squeezes the arms 12 towards the base portion 10. FIG. 6 illustrates the screwdriver handle 5 in a closed configuration, whereby the arms 12 are positioned resting in the slotted regions 27 and generally planar to the longitudinal axis of the base portion 10.

Figure 7:
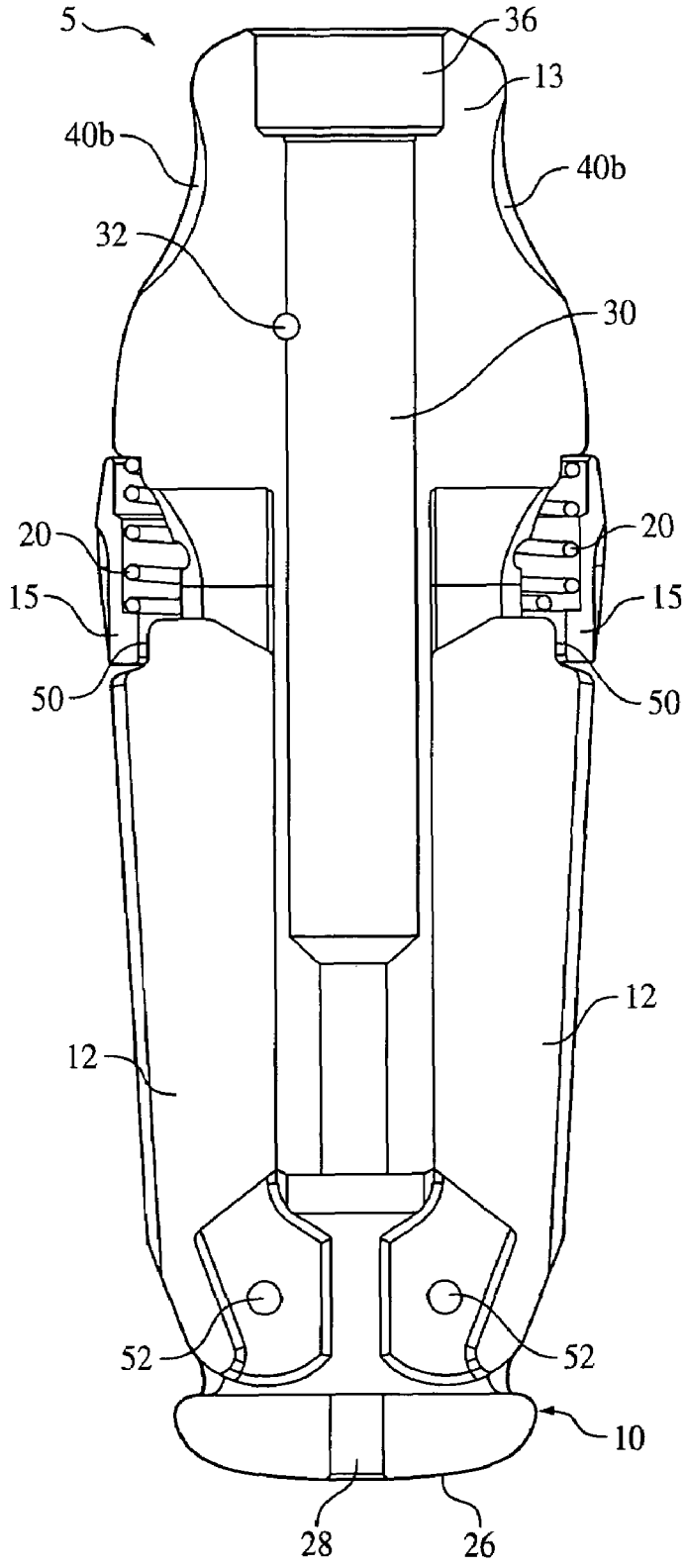
FIG. 7 illustrates a cross-sectional view of a screwdriver handle in a closed configuration according to an embodiment of the invention.

As illustrated in the cross-sectional view of FIG. 7, the arms 12 of the screwdriver handle 5 remains in the closed (locked) position when the locking sleeve 15 engages the indented lip 50 of the arm 12. This occurs when the spring member 20 extends to its natural/relaxed state thereby moving the locking sleeve 15 in a longitudinal direction away from the lower end 13 of the base portion 10. With reference to FIGS. 1 through 7, in order to once again open the arms 12 into a "T" shape configuration, the locking sleeve 15 slidably moves (with the aid of a user) along the longitudinal axis of the base portion 10 in a direction towards the lower end of the base portion 10. In doing so, the spring member 20 is pushed into a coiled configuration because the spring member 20 is connected to and is held in place by the sleeve member 15. Once the locking sleeve 15 releases the indented lip 50 of the arms 12, the arms 12 are released and pivotally rotated on the pins 52 into the "T" shape (open) configuration.

Thus, the torsion spring 25 accumulates potential energy when the arms 12 are pushed into the slotted region 27 (i.e., the arms are in the closed position). Furthermore, this potential energy is retained so long as the arms 12 are squeezed against the base portion 10, and preferably held in place by the locking sleeve 15. When, the locking sleeve 15 is moved toward the lower end 13 of the base portion 10, then the potential energy of the torsion springs 25 are released, thereby creating kinetic energy causing the arms 12 to pivot outward into the open "T" shape configuration.

The spring member 20 accumulates potential energy when the locking sleeve 15 moves toward the lower end 13 of the base portion because in this position the spring member 20 is in a coiled configuration. When, the spring member 20 is released from its coiled state back to its natural/relaxed configuration, the stored potential energy in the spring member 20 transfers into kinetic energy, thereby causing the locking sleeve 15 to move away from the lower end 13 of the base portion 10. However, the locking sleeve 15 is prevented from moving any further than the position of the catch 19 of the base portion 10. Thus, due to the catch 19 and the limited translation of the locking sleeve 15 along the longitudinal axis of the base portion 10 in a direction away from the lower end 13 of the base portion, there always remains some potential energy stored in the spring member 20. Accordingly, the catch 19 prevents the locking sleeve 15 and spring member 20 from falling off of the screwdriver handle 5 on one side, while the tapered configuration of the tapered joining segment 11 prevents the locking sleeve 15 and spring member 20 from falling off of the screwdriver handle 5 on the other side.

Figure 8:
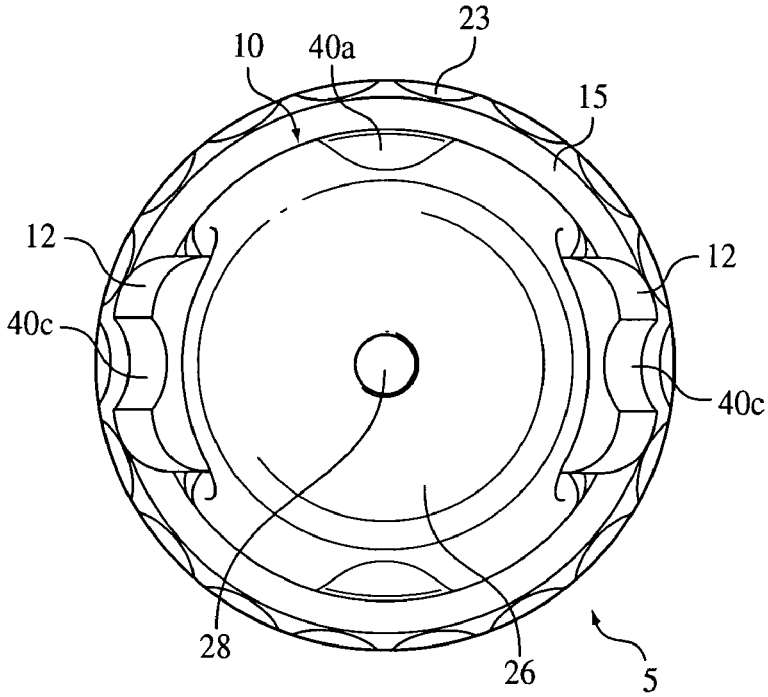
FIG. 8 illustrates a top view of a screwdriver handle according to an embodiment of the invention.
Figure 9:
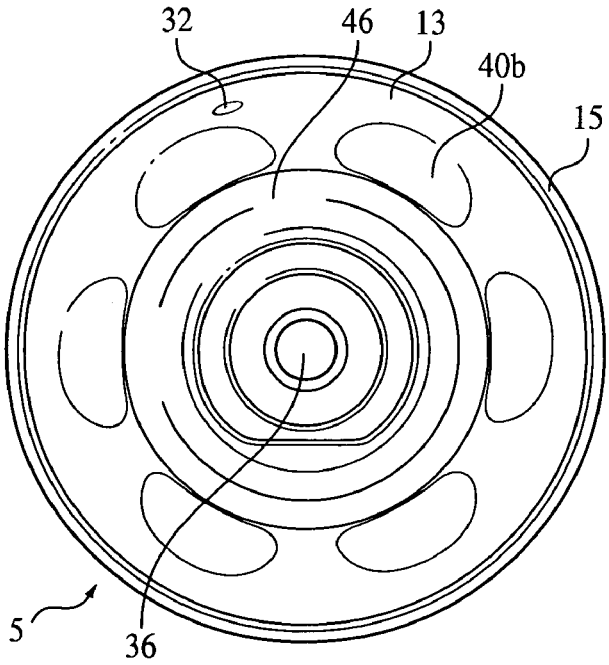
FIG. 9 illustrates a bottom view of a screwdriver handle according to an embodiment of the invention.

FIGS. 8 and 9 illustrate the top and bottom views of the screwdriver handle 5, respectively. These views illustrate the generally round configuration of the screwdriver handle 5, although, as previously mentioned, any shape configuration may be incorporated into the design of the screwdriver handle 5, and the embodiments of the limitation are not limited to any particular shape configuration.

Generally, as illustrated in FIGS. 1 through 9, the embodiments of the invention provide a screwdriver handle 5 comprising a base portion 10 and a pair of arms 12 connected to the base portion 10, wherein the pair of arms 12 are diametrically opposed to one another at a position transverse to a longitudinal axis of the base portion 10. The screwdriver handle 5 further comprises a locking sleeve 15 mounted around the base portion 10 and adapted to engage the pair of arms 12; a spring member 20 mounted around the base portion 10 and adapted to engage the locking sleeve 15; and a torsion spring 25 connected to the base portion 10 and each of the pair of arms 12. Preferably, the base portion 10 comprises a hollow inner shaft chamber 30, and wherein the base portion 10 comprises at least one gripping indent feature 40*a*, 40*b*.

Additionally, the pair of arms 12 are adapted to articulate from a first position planar to a longitudinal axis of the base portion 10 to a second position transverse to the longitudinal axis of the base portion 10, wherein the pair of arms 12 are diametrically opposed to one another when in the second position. The screwdriver handle 5 further comprises a pin 52 connecting the pair of arms 12 to the base portion 10. Moreover, the locking sleeve 15 is adapted to move along a longitudinal axis of the base portion 10. Preferably, the pair of arms 12 are unconnected to one another.

The screwdriver handle 5 provided by the embodiments of the invention may be used in any application where a screwdriver is used, and is particularly useful in heavy torque applications, where a user can open the arms 12 and apply greater torque on a screw by rotating the arms 12 of the screwdriver handle 5. Furthermore, in instances where the user does not need to apply significant amounts of torque to a screw or in applications where there are spatial limitations, the arms 12 can be kept in the locked position (i.e., with the locking sleeve 15 engaging the indented lip 50 of the arms 12), and the screwdriver handle 5 may be used in a traditional manner. In this regard, because the gripping indent features 40*c* of the arms 12 contours with the shape and configuration of the gripping indent features 40*a* of the outer body surface 14 of the base portion 10, a user can get a very good ergonomic grip on the screwdriver handle 5. Moreover, the matching shape and configuration of the gripping indent features 40*a*, 40*c* contributes to the overall aesthetics of the screwdriver handle 5.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments of the invention have been described in terms of preferred embodiments, those skilled in the art will recognize that the embodiments of the invention can be practiced with modification within the spirit and scope of the appended claims.

What is claimed is:

1. A screwdriver handle comprising:

a base portion;

at least one arm pivotally connected to said base portion; and a locking sleeve mounted on said base portion, wherein a tip of said at least one arm comprises an indented lip adapted to engage said locking sleeve.

2. The screwdriver handle of claim 1, further comprising a spring member mounted on said base portion and adapted to engage said locking sleeve.

3. The screwdriver handle of claim 1, further comprising a torsion spring connected to each of said base portion and said at least one arm.

4. The screwdriver handle of claim 1, wherein said base portion comprises a hollow inner shaft chamber.

5. The screwdriver handle of claim 1, wherein said base portion comprises at least one gripping indent feature.

6. The screwdriver handle of claim 1, wherein said at least one arm is adapted to articulate from a first position planar to a longitudinal axis of said base portion to a second position transverse to said longitudinal axis of said base portion.

7. The screwdriver handle of claim 6, wherein said at least one arm comprises two arms, and wherein said two arms are diametrically opposed to one another when in said second position.

8. The screwdriver handle of claim 1, further comprising a pin connecting said at least one arm to said base portion.

9. The screwdriver handle of claim 1, wherein said locking sleeve is adapted to engage said at least one arm, and wherein said locking sleeve is adapted to move along a longitudinal axis of said base portion.

10. The screwdriver handle of claim 1, wherein said at least one arm comprises a pair of arms that are unconnected to one another.

11. The screwdriver handle of claim 1, wherein said pair of arms are unconnected to one another.

12. A screwdriver handle comprising:

a base portion;

a pair of arms connected to said base portion, wherein said pair of arms are diametrically opposed to one another at a position transverse to a longitudinal axis of said base portion; and locking means operatively connected to said base portion, wherein a tip of each of said pair of arms comprises an indented lip adapted to engage said locking means.

13. The screwdriver handle of claim 12, further comprising:

a spring member mounted around said base portion and adapted to engage said locking sleeve; and a torsion spring connected to said base portion and each of said pair of arms, wherein said locking sleeve is mounted around said base portion and is adapted to engage said pair of arms, wherein said base portion comprises a catch, and wherein said locking sleeve comprises a stop feature adapted to engage said catch.

14. The screwdriver handle of claim 12, wherein said base portion comprises a hollow inner shaft chamber.

15. The screwdriver handle of claim 12, wherein said base portion comprises at least one gripping indent feature.

16. The screwdriver handle of claim 12, wherein said pair of arms are adapted to articulate from a first position planar to a longitudinal axis of said base portion to a second position transverse to said longitudinal axis of said base portion.

17. The screwdriver handle of claim 16, wherein said pair of arms are diametrically opposed to one another when in said second position.

18. The screwdriver handle of claim 12, further comprising a pin connecting said pair of arms to said base portion.

19. The screwdriver handle of claim 12, wherein said locking sleeve is adapted to move along a longitudinal axis of said base portion.

20. A screwdriver handle comprising:

a base portion;

a pair of arms pivotally connected to said base portion;

locking means for locking said pair of arms in a first position planar to a longitudinal axis of said base portion, wherein a tip of each of said pair of arms comprises an indented lip adapted to engage said locking means;

first energy means for providing energy to said locking means to articulate from a locked to an unlocked position; and second energy means for providing energy to said pair of arms to articulate from said first position planar to said longitudinal axis of said base portion to a second position transverse to said longitudinal axis of said base portion.

* * * * *